US009196217B2

(12) United States Patent
Chen

(10) Patent No.: US 9,196,217 B2
(45) Date of Patent: Nov. 24, 2015

(54) TIMING CONTROLLER, DISPLAY DEVICE AND DRIVING METHOD THEREOF

(71) Applicant: RAYDIUM SEMICONDUCTOR CORPORATION, Hsinchu (TW)

(72) Inventor: Ying-Lieh Chen, Tainan (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 238 days.

(21) Appl. No.: 13/763,657

(22) Filed: Feb. 9, 2013

(65) Prior Publication Data

US 2014/0062994 A1 Mar. 6, 2014

(30) Foreign Application Priority Data

Aug. 31, 2012 (TW) ..... 101131869 A

(51) Int. Cl.
*G09G 5/00* (2006.01)
*G09G 3/36* (2006.01)

(52) U.S. Cl.
CPC ..... *G09G 5/003* (2013.01); *G09G 3/3688* (2013.01); *G09G 2310/0243* (2013.01); *G09G 2330/025* (2013.01); *G09G 2330/06* (2013.01); *G09G 2370/08* (2013.01)

(58) Field of Classification Search
CPC . G09G 5/003; G09G 3/3688; G09G 2370/08; G09G 2330/025; G09G 2330/06; G09G 2310/0243
See application file for complete search history.

(56) References Cited

U.S. PATENT DOCUMENTS

| | | | | |
|---|---|---|---|---|
| 2007/0126686 | A1* | 6/2007 | Chang et al. | 345/98 |
| 2010/0156879 | A1* | 6/2010 | Hong et al. | 345/213 |
| 2010/0156885 | A1* | 6/2010 | Cho et al. | 345/214 |
| 2010/0225637 | A1* | 9/2010 | Jeon et al. | 345/213 |
| 2011/0063278 | A1* | 3/2011 | Han | 345/212 |
| 2013/0050176 | A1* | 2/2013 | Kim et al. | 345/214 |

* cited by examiner

*Primary Examiner* — Dwayne Bost
*Assistant Examiner* — Stefan M Oehrlein

(57) ABSTRACT

The present invention discloses a timing controller including a driving signal generation module, a time-locking module, and a first logic circuit. The driving signal generation module generates a first isolation signal. The time-locking module detects whether or not all of a plurality of source driving units of a source driver lock a timing signal. The first logic circuit generates a second isolation signal, and adjusts the second isolation signal according to the output status of the first isolation signal. The gate driver selectively outputs a plurality of gate driving signals to a plurality of gate driving units of the gate driver according to the output status of the second isolation signal.

9 Claims, 9 Drawing Sheets

TIMING CONTROLLER, DISPLAY DEVICE AND DRIVING METHOD THEREOF

BACKGROUND OF THE INVENTION

1. Field of the Invention

The present invention relates to a timing controller, a display device and a driving method thereof; in particular, to a timing controller, a display device, and a driving method thereof adapted for decreasing noise interference and preventing occurrence of abnormal display.

2. Description of Related Art

In general, Electromagnetic Compatibility (EMC) includes Electromagnetic Interference (EMI) and Electromagnetic Susceptibility (EMS). To verify the Electromagnetic Susceptibility (EMS), it's very important to test the Electrostatic Discharge (ESD). It's noteworthy that Electromagnetic discharge (ESD) designates that an electronic device has had some type of malfunction including temporary breakdown, permanent damage or another malfunctions as a result of being over charged. Specifically, a display device may have abnormal display, frozen screen, and abnormal shutdown due to Electrostatic Discharge (ESD).

For instance, a conventional display device comprises a timing controller, a source driver, and a gate driver, wherein the timing controller can control the operation of the source driver and the gate driver for displaying images on the panel of display device. For an image to display properly, the timing controller should verify whether each source driving unit of the source driver has locked a timing signal to ensure data accuracy. However, when electrostatic discharge starts to build up in the source driver or the timing controller, the source driving unit may have loose lock causing the timing controller to send abnormal data to the source driver and to display abnormally images on the display panel.

In practice, the timing controller of a conventional display device should stop sending data to the source driver and display a black screen when the display device has loose lock due to the electrostatic interference so as to prevent the displaying of abnormal images. However, the appearance of a black screen decreases the display quality and users are made aware of the abnormal display. Accordingly, it's necessary to have a display device in which the display quality can be improved when the electrostatic interference becomes prominent without negatively influencing the operation efficiency.

SUMMARY OF THE INVENTION

The object of the present invention is to provide a timing controller adapted for decreasing noise interference and to prevent abnormal display. When the display device equipped with the timing controller disclosed encounters has been interfered by noise, the timing controller disable the gate driver to have the display device continue displaying the previous frame with accurate data to improve the display quality.

In order to achieve the aforementioned objects, a timing controller is provided according to an embodiment of the present invention. The timing controller is respectively coupled to a source driver and a gate driver. The timing controller comprises a driving signal generation module, a time-locking module, and a first logic circuit. The driving signal generation module is used for generating a first isolation signal. The time-locking module is coupled to the source driver and is used for detecting whether the plurality of source driving units of the source driver all have locked a timing signal to have the source driver correspondingly outputting the first timing locking signal adjusted. The first logic circuit is coupled to the driving signal generation module and the time-locking module. The first logic circuit is used for generating a second isolation signal wherein the output status of the second isolation signal is adjusted based on the output status of the first time-locking signal and the first isolation signal. The gate driver selectively outputs the plurality of gate driving signals to the plurality of gate driving units of the gate driver based on the output status of the second isolation signal.

The object of the present invention is to provide a display device capable of decreasing the noise interference and preventing abnormal display. When the display device is interfered by noise, the timing controller of the display device disables the operation of the gate driver to have the display device displaying the previous frame of accurate data to improve the display quality.

In order to achieve the aforementioned objects, a display device is provided according to an embodiment of the present invention comprising a display panel, a source driver, a gate driver, and a timing controller. The source driver comprises a plurality of source driving units with each source driving unit being at least coupled to one of the data lines of the display panel. The gate driver comprises a plurality of gate driving units with each gate driving unit being at least coupled to one of the scan lines of the display panel. The timing controller comprises a driving signal generation module, a time-locking module, and a first logic circuit. The gate driver generates a first isolation signal and generates a plurality of gate driving signals, sequentially. The time-locking module is coupled to the source driver. The time-locking module is used for detecting whether the source driving units all have locked a timing signal to accordingly output a first time-locking signal adjusted by the source driver. The first logic circuit is coupled to the driving signal generation module and the time-locking module for generating a second isolation signal wherein the output status of the second isolation signal is adjusted based on the output status of the first time-locking signal and the first isolation signal. The gate driver selectively outputs the plurality of gate driving signals to the plurality of gate driving units of the gate driver based on the output status of the second isolation signal.

The object of the present invention is to provide a driving method for a display device, capable of decreasing noise interference and preventing abnormal display. When the display device is interfered by noise, the timing controller of the display device disable the operations of the gate driver to have the display device continue displaying a previous frame contains accurate data to improve the display quality.

In order to achieve the aforementioned objects, a driving method of a display device is provided according to an embodiment of the present invention. The driving method comprising: generating a first isolation signal and generating a plurality of gate driving signals, sequentially; detecting whether the plurality of source driving units all have locked a timing signal to correspondingly output a first time-locking signal being adjusted by the source driver; generating a second isolation signal with the output status thereof being adjusted based on the output status of the first time-locking signal and the first isolation signal; selectively outputting the plurality of gate driving signals to the plurality of gate driving units of the gate driver based on the output status of the second isolation signal.

To sum up, when the display device provided by the embodiments of the instant invention happen to loose lock due to noise interference, the timing controller of the display device prevents the interfered data being written into the corresponding capacitor to have the display device continue displaying data of the previous frame. When the source driver being reconfigured by the timing controller to have correct timing signals, the time controller re-drive the gate driving units of the gate driver for new data to be written. Accordingly, the display device of the present invention assures the accuracy of display data while decreases the occurrence of displaying the black screen and abnormal image thereby improves the display quality.

In order to further the understanding regarding the present invention, the following embodiments are provided along with illustrations to facilitate the disclosure of the present invention.

DETAILED DESCRIPTION OF THE PREFERRED EMBODIMENTS

The aforementioned illustrations and following detailed descriptions are exemplary for the purpose of further explaining the scope of the present invention. Other objectives and advantages related to the present invention will be illustrated in the subsequent descriptions and appended drawings.

Figure 1A:
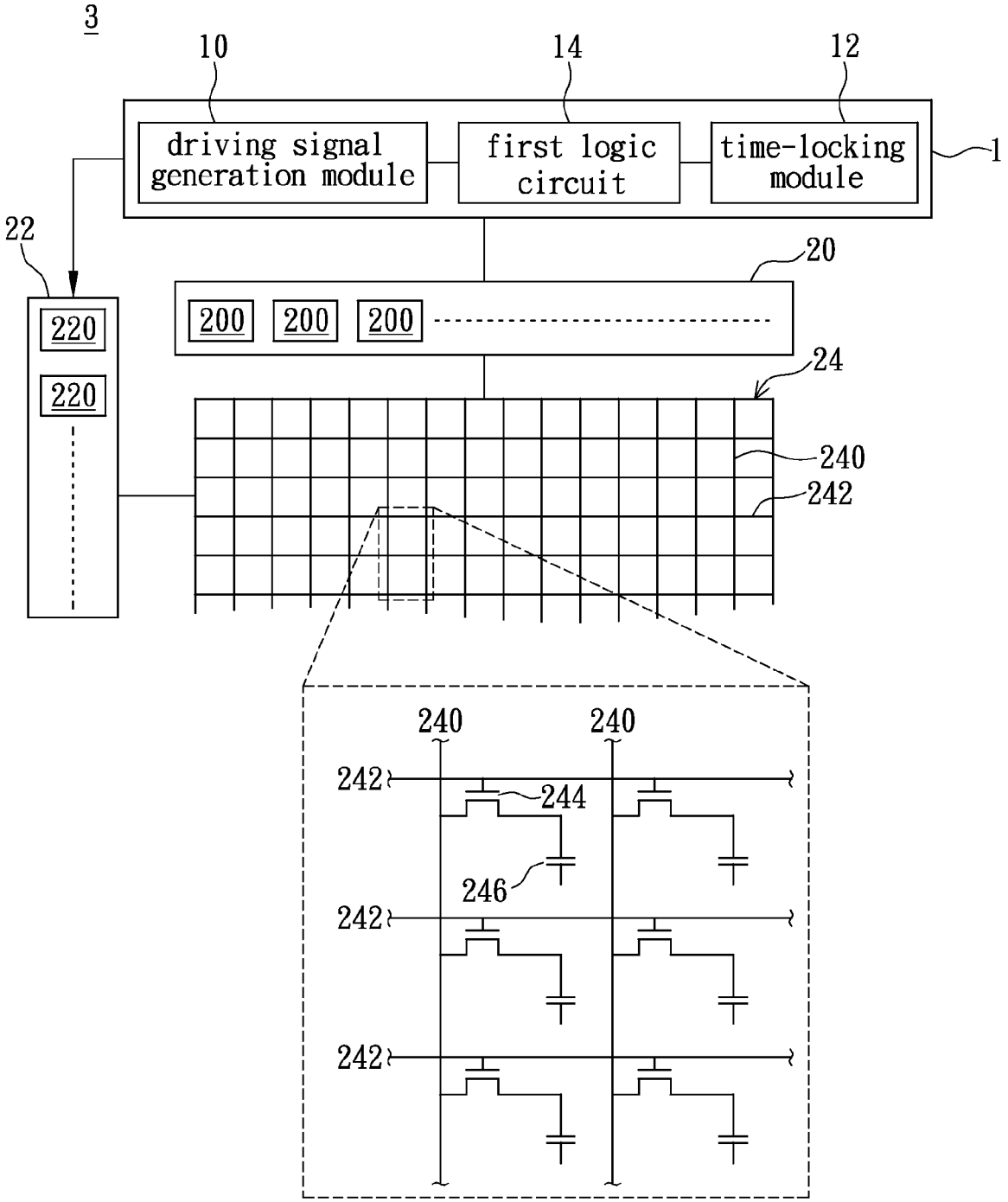
FIG. 1A shows a function block diagram of a display device according to an embodiment of the present invention.
Figure 2:
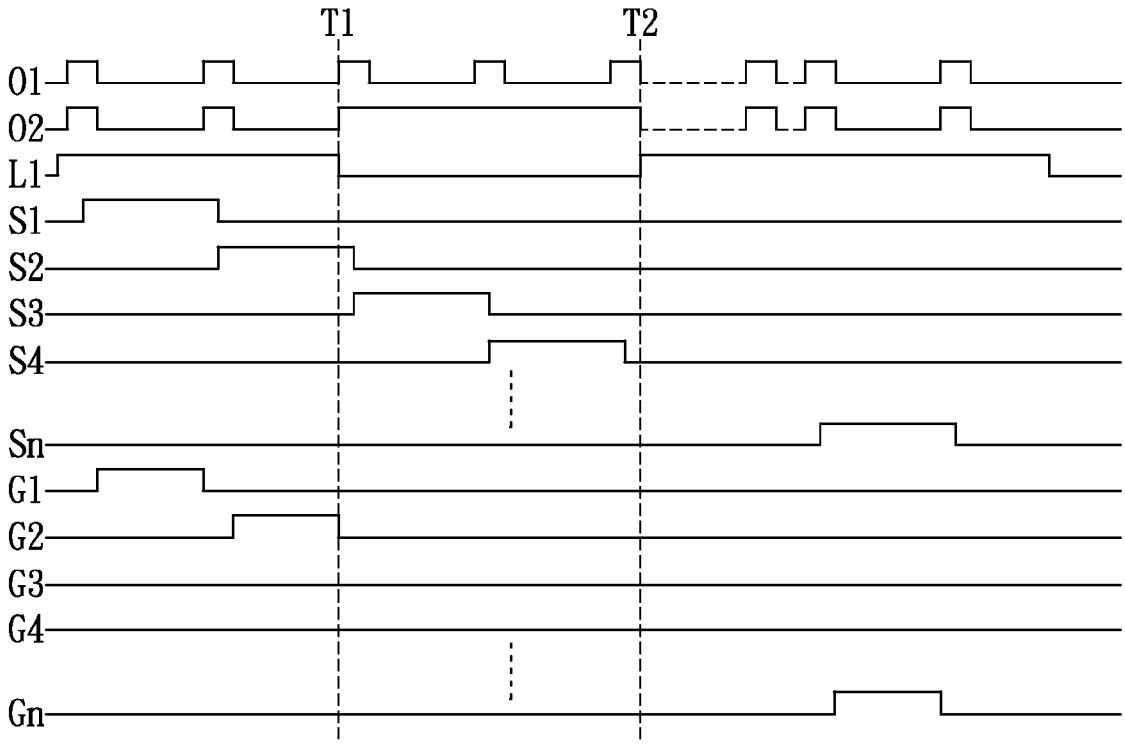
FIG. 2 shows a timing diagram according to an embodiment of the present invention.

Please refer to FIG. 1A in conjunction with FIG. 2. FIG. 1A shows a function block diagram of a display device according to an embodiment of the present invention, and FIG. 2 shows a timing diagram according to the embodiment of the present invention. As shown in FIG. 1A, a display device 3 comprises a timing controller 1, a source driver 20, a gate driver 22, and a panel 24. The panel 24 further comprises a plurality of data lines 240, a plurality of scan lines 242, a plurality of transistors 244, and a plurality of capacitors 246. Those skilled in the art should understand the structure and the operation of the panel 24, and further descriptions are omitted herein the instant embodiment.

The timing controller 1 is respectively coupled to the source driver 20 and the gate driver 22, and is used for controlling the source driver 20 and the gate driver 22 driving the panel 24 to display. Herein, the timing controller 1 comprises a driving signal generation module 10, a time-locking module 12, and a first logic circuit 14. The driving signal generation module 10 is coupled to the first logic circuit 14, and the first logic circuit 14 is coupled to the time-locking module 12. Additionally, the source driver 20 and the gate driver 22 comprise a plurality of source driving units 200 and a plurality of gate driving units 220, respectively. The detailed description for each element of the display device 3 is provided as follow.

The driving signal generation module 10 generates a first isolation signal O1 and generates a plurality of gate driving signals S1~Sn, sequentially. In practice, the gate driving signals S1~Sn are signals being outputted sequentially while the first isolation signal O1 is a periodical pulse. Herein, the first isolation signal O1 can be viewed as periodically switching between two output status i.e., the high-voltage level and the low-voltage level. In other words, the output status of a first isolation signal O1 can switch from a low-voltage level to a high-voltage level or from a high-voltage level to a low-voltage level. Moreover, the output time of each first isolation signal O1 pulse exactly includes the switch timing of two adjacent gate driving signals.

The time-locking module 12 is coupled to the source driver 20. The time-locking module 12 detects whether all the source driving units 200 of the source driver 20 have locked a timing signal and outputs a first time-locking signal L1 being adjusted by the source driver 20, accordingly. In practice, when the source driving units 200 of the source driver 20 all have locked the timing signal, and the output status of the first time-locking signal L1 is at a high-voltage level; when at least one source driving unit 200 of the source driver 20 has not locked the timing signal, the output status of the first time-locking signal L1 is at a low-voltage level. In other words, the output status of the first time-locking signal L1 is determined by the operation of the source driving units 200.

For example, when the source driving units 200 happen to loose lock due to electrostatic discharge or noise interference, the output status of the first time-locking signal L1 is at a low-voltage level. In the situation where loose lock happens, because that the data outputted from the timing controller 1 to the source driver 20 is not accurate and is not usable, the time-locking module 12 needs to offer timing signals as reference to each source driving unit 200 until each source driving unit 200 has locked the timing signal. When each source driving unit 200 has locked the timing signal again, the output status of the first time-locking signal L1 outputted from the time-locking module 12 is at a high-voltage level, such that the accuracy of data sent from the timing controller 1 to the source driver 20 can be ensured.

The first logic circuit 14 generates a second isolation signal O2 and adjusts the output status of the second isolation signal O2 based on the output status of the first time-locking signal L2 and the first isolation signal O1. To be specific, when the first logic circuit 14 determines that the output status of the first time-locking signal L1 indicates the source driving units 200 of the source driver 20 all have locked the timing signal, the output status of the second isolation signal L2 being outputted from the first logic circuit 14 is the same as the output status of the first isolation signal L1. On the other hand, when the first logic circuit 14 determines that the output status of the first time-locking signal L1 indicates that at least one source driving unit 200 has not locked the timing signal, the output status of the second isolation signal L2 being outputted from the first logic circuit 14 disables the gate driver 22 from outputting the gate driving signals S1~Sn (i.e. the superimposed gate driving signals G1~Gn are not being outputted). In other words, the output status of the second isolation signal L2 is at a high-voltage level.

Generally speaking, the first logic circuit 14 adjusts the output status of the first isolation signal O1 based on the output status of the first time-locking signal L1, and the second isolation signal O2 is actually the adjusted first isolation signal O1. In other words, the first logic circuit 14 generates the second isolation signal O2 according to both the output status of the first time-locking signal L1 and the output status of the first isolation signal O1.

In the embodiment shown in FIG. 2, the first time-locking signal L1 is switched to a low-voltage level at time T1, indicating the loose lock has happened to at least one source driving unit 200 as result of electrostatic discharge or noise interference at time T1, while the output status of the first isolation signal O1 is at a high-voltage level henceforth the output status of the second isolation signal O2 is simultaneously switched to a high-voltage level at time T1. It is noteworthy that, since the output status of the first time-locking signal L1 switches to a high-voltage level at time T2, indicating that the source driving units 200 still loose lock from time T1 to T2, hence and thus the output status of the second isolation signal O2 is still at a high-voltage level.

Figure 3:
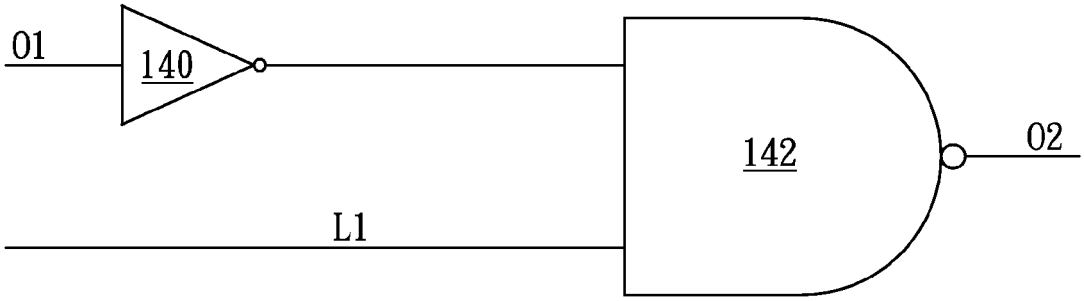
FIG. 3 shows a circuit diagram of the first logic circuit according to an embodiment of the present invention.

For further elaboration on the implementation of the first logic circuit 14, please refer to FIG. 3. FIG. 3 shows a circuit diagram of the first logic circuit according to an embodiment of the present invention. As shown in FIG. 3, the first isolation signal O1 is connected to an input end of a NAND gate 142 through a inverter 140, the first time-locking signal L1 is connected to another input end of the NAND gate 142, and the output end of the NAND gate 142 output the second isolation signal O2. It is noteworthy that although the instant embodiment discloses the circuit diagram shown in FIG. 3, those skilled in the art should be able to deduce other embodiments according to the disclosure of the present invention, and the present invention is not limited thereto.

Please again refer to FIG. 1A in conjunction with FIG. 2. The gate driver 22 selectively outputs the plurality of gate driving signals S1~Sn to the plurality of gate driving units 220 based on the output status of the second isolation signal O2. The second isolation signal O2 is used for shielding the gate driving signals S1~Sn. When the gate driver 22 determines that the output status of the second isolation signal O2 is at a high-voltage level, stop outputting the gate driving signals S1~Sn. For the ease of explanation, the gate driver 22 can be viewed as being capable of logically combining the second isolation signal O2 and the gate driving signals S1~Sn, and outputs the superimposed gate driving signals G1~Gn to the plurality of gate driving units 220 of the gate driver 22.

As described in the embodiment of FIG. 2, prior to time T1, the output status of the second isolation signal O2 is not fixed at the high-voltage level, such that the gate driving signals S1, S2 are not entirely shielded by the second isolation signal O2. At the instant, the function of the second isolation signal O2 is to separate the sequentially outputted gate driving signals S1, S2, generating a time interval between the superimposed gate driving signals G1 and G2 to prevent the corresponding scan lines 242 from being turned on simultaneously. However, the output status of the second isolation signal O2 is fixed at a high-voltage level within the time interval between time T1 to time T2 such that the gate driving signals S1, S2 are entirely shielded by the second isolation signal O2. That is, the superimposed gate driving signals G3, G4 is equivalent to an output with low-voltage level. The scan lines 242 corresponded to the superimposed gate driving signals G3, G4 therefore does not carry relatively high voltage causing the transistor 244 to be in the non-conducting state. Accordingly the incorrect data transmitted by a data line 240 is not written in a corresponded capacitor 246, such that the accurate data which has already stored in the corresponded capacitor 246 will not lost.

Figure 1B:
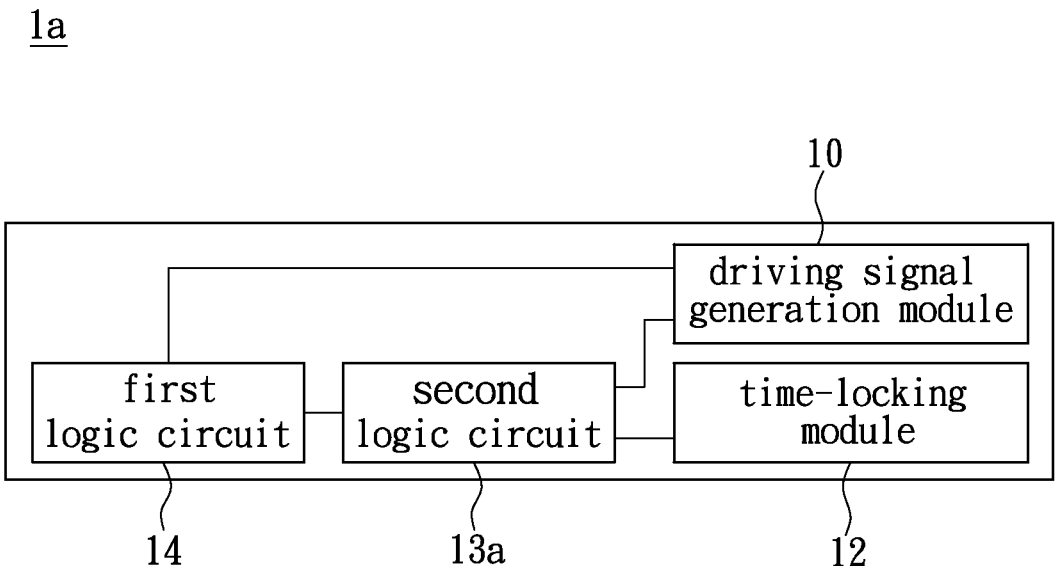
FIG. 1B shows a function block diagram of a display device according to another embodiment of the present invention.
Figure 4:
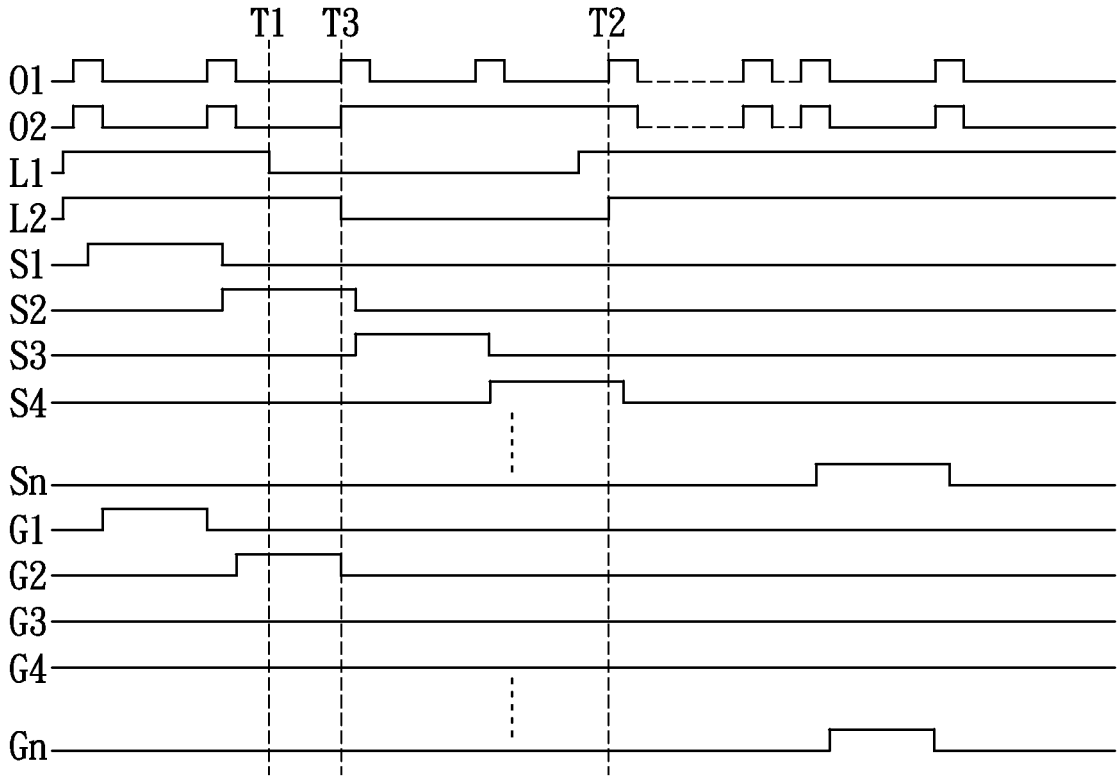
FIG. 4 shows a schematic diagram of the signal timing according to another embodiment of the present invention.

Please refer to FIG. 1B in conjunction with FIG. 4. FIG. 1B shows a function block diagram of a display device according to another embodiment of the present invention. FIG. 4 shows a schematic diagram of the signal timing according to another embodiment of the present invention. The source driver 20, the gate driver 22, and the panel 24 of the embodiment are essentially the same as the aforementioned embodiment, hence the description is omitted herein. Different from the aforementioned embodiment, a timing controller 1*a* further comprises a second logic circuit 13*a*. Additionally, the embodiment discloses the driving method of the timing controller 1*a* for the case of when the loose lock happens between two first isolation signals O1.

As shown in FIG. 1B, besides the driving signal generation module 10, the time-locking module 12 and the first logic circuit 14, the timing controller 1*a* further comprises the second logic circuit 13*a*. Herein, the second logic circuit 13*a* adjusts the output status of the first time-locking signal L1 based on the first isolation signal O1 so as to output a new second time-locking signal L2. In other words, in the instant embodiment, the first isolation signals O1 are used as sampling signals. For example, the first time-locking signal can be sampled at the positive edge trigger or negative edge trigger of the first isolation signal O1 and converted into the second time-locking signal L2 to have fixed output status of the time-locking signal L2 between any two first isolation signals O1.

Take the embodiment shown in FIG. 4 for example, when the output status of the first time-locking signal L1 at time T1 is switched to a low-voltage level. That is, at least one source driving unit 200 between two first isolation signals O1 happens to loose lock due to electrostatic discharge or noise interference. In practice, the data being written at time T1 is an accurate timing signal, but the timing signal locked by the data received at time T3 is not. To accommodate the previous described scenario, the second logic circuit 13*a* of the instant embodiment can adjust the output status of the first time-locking signal L1 to have the output status of the second time-locking signal L2 outputted from the second logic circuit 13*a* is at a high-voltage level between time T1 to time T3. Also, even though the output status of the first time-locking signal L1 has switched to a high-voltage level prior to time T2 (indicating the training of the timing signal has been completed)), the second logic circuit 13*a* continue adjusts the output status of the first time-locking signal L1 so that the output status of the second time-locking signal L2 from the second logic circuit 13*a* is at a low-voltage level from time T3 to time T2.

It's noteworthy that though the example in the instant embodiment is to have the second logic circuit 13*a* determining whether the output status of the first time-locking signal L1 is at a high-voltage level at the positive edge of the first isolation signals. However, those skilled in the art should be able to understand that the second logic circuit 13*a* can also determine whether the output status of the first time-locking signal L1 is at a high-voltage level when the first isolation signals O1 are negative-edge triggered, and the present invention is not limited thereto.

Figure 5:
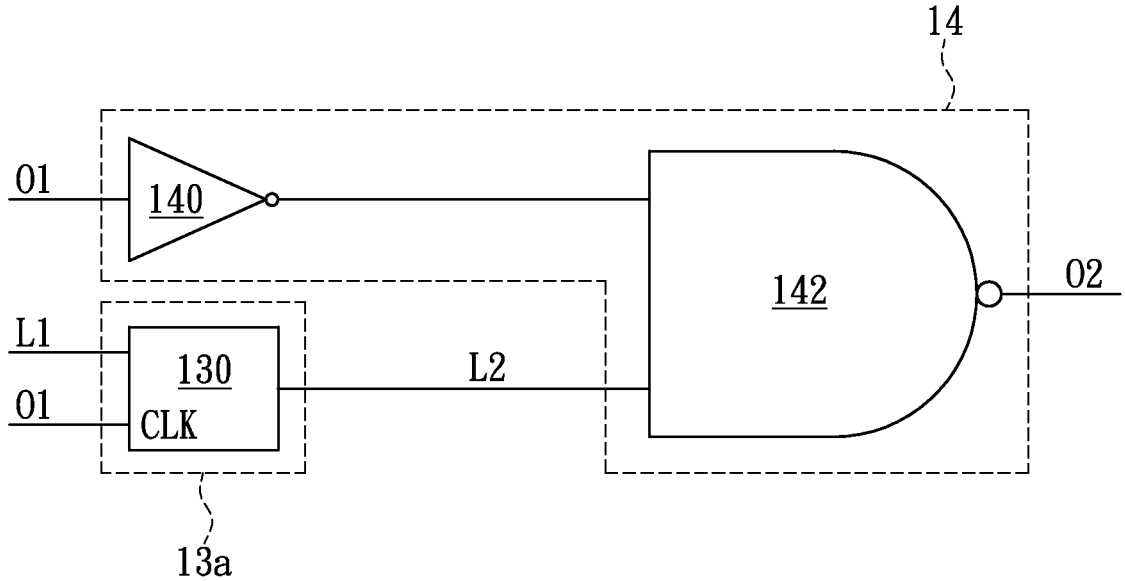
FIG. 5 shows a circuit diagram of the first logic circuit and the second logic circuit according to another embodiment of the present invention.

For details on the implementation of the second logic circuit 13*a*, please refer to FIG. 5 which shows a circuit diagram of the first logic circuit and the second logic circuit according to another embodiment of the present invention. As shown in FIG. 5, a combination of the first logic circuit 14 and the second logic circuit 13*a* is disclosed, wherein the first isolation signal O1 is connected to the an input end of the NAND gate 142 through the inverter 140 of the first logic circuit 14. The first time-locking signal L1 and the first isolation signal O1 feed into the sampling circuit 130 of the second logic circuit 13*a*. After sampling the first time-locking signal L1 using the first isolation signal O1, the sampling circuit 130 outputs the second time-locking signal L2. Additionally, the second time-locking signal L2 from the sampling circuit 130 is connected to another input end of the NAND gate 142, so that the second isolation signal O2 is outputted from the output end of the NAND gate 142. It's noteworthy that even though the instant embodiment describes the circuit in FIG. 5, those skilled in the art should be able to deduce other embodiments according to the disclosure of the present invention, and the present invention is not limited thereto.

Figure 1C:
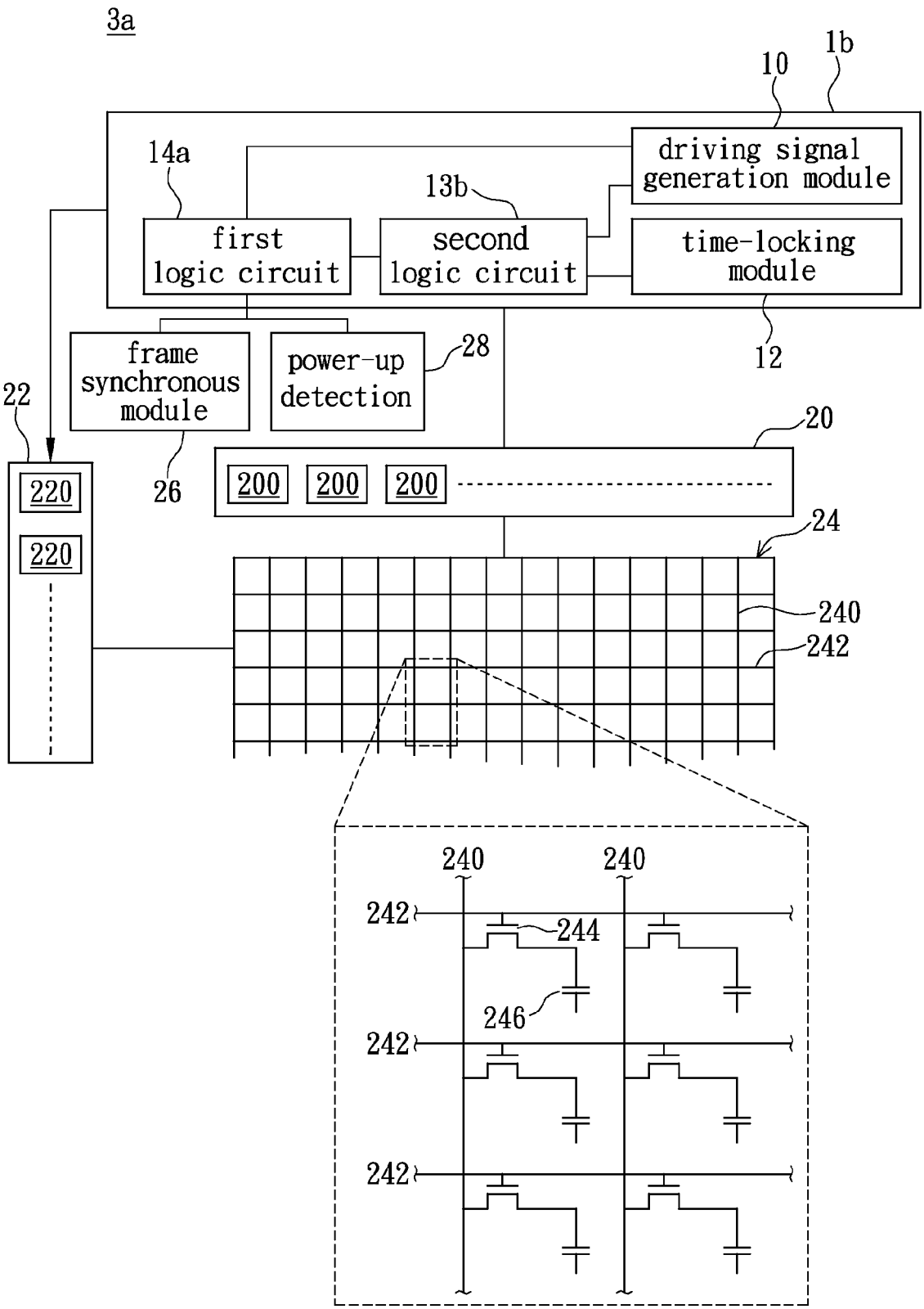
FIG. 1C shows a function block diagram of a display device according to another embodiment of the present invention.
Figure 6:
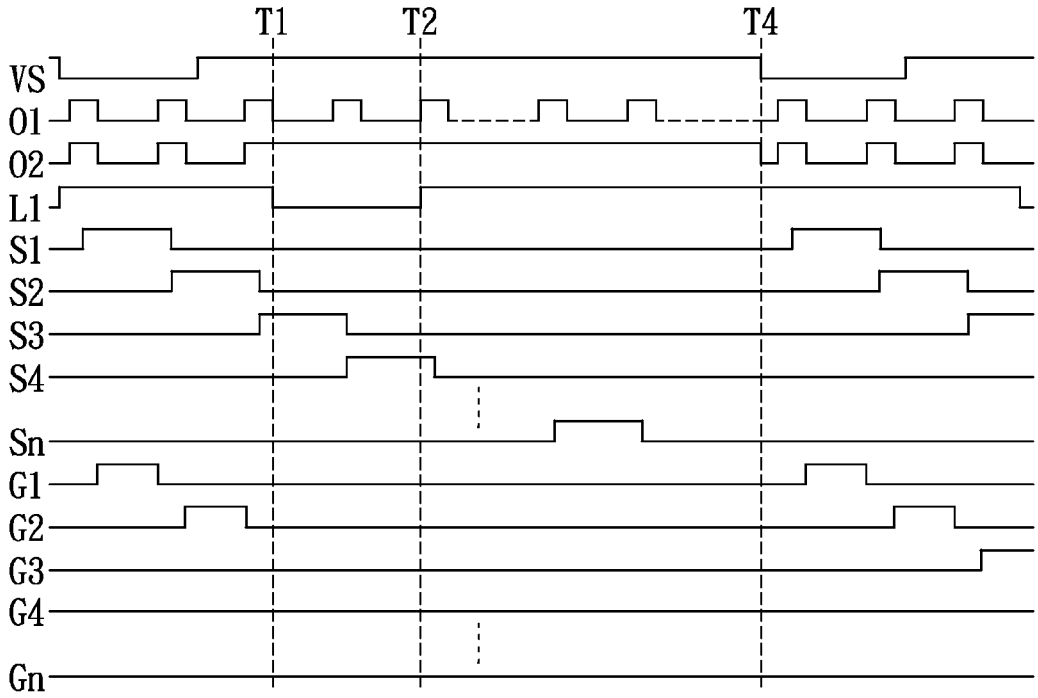
FIG. 6 shows a timing diagram according to another embodiment of the present invention.

Please refer to FIG. 1C in conjunction with FIG. 6. FIG. 1C shows a function block diagram of a display device according to another embodiment of the present invention. FIG. 6 shows a timing diagram according to another embodiment of the present invention. The similarly between the display device of FIG. 1A and the FIG. 1C in that the display device includes the source driver 20, the gate driver 22, and the panel 24 and the description is omitted herein. The difference between the display device of FIG. 1A and the FIG. 1C in that, the display device 3*a* of the instant embodiment further comprises an improved first logic circuit 14*a* and a third logic circuit 13*b*. Moreover, the timing controller 1*b* of the instant embodiment waits till the output status of the first time-locking signal indicating that the source driver 20 has locked a timing signal and writes data into the panel 24 in the next frame after the occurrence of loose lock and the process for retraining the timing signal.

As shown in figures, a frame synchronous module 26 can output a frame initialize signal VS, wherein the frame initialize signal VS is a vertical synch-image signal, a horizontal synch-image signal, or other synch-control signals. It's noteworthy that when the output status of the first time-locking signal L1 switches to a low-voltage level at time T1 indicating that the first time-locking signal L1 has been interfered by external signals (i.e. at least one source driving unit 200 has encounter loose lock between two first isolation signals O1 as the result of electrostatic discharge or noise interference.) However, the source driving unit 200 can immediately complete the timing signal training at time T2 to have the frame displaying frequency of the panel 24 synchronized with the driving timing sequence of each gate driving unit 220 to offer a relative better visual perception. In this embodiment, the first logic circuit 14*a* adjusts the output status of the first time-locking signal L1 so that the output status of the second time-locking signal L2 maintains at a high-voltage level between time T2 to time T4. The output status of the second time-locking signal L2 is again switched to a low-voltage level at the start of next time frame (e.g., time T4) after the output status of the second time-locking signal L2 indicates that the source driver 20 has locked the timing signal.

Figure 7:
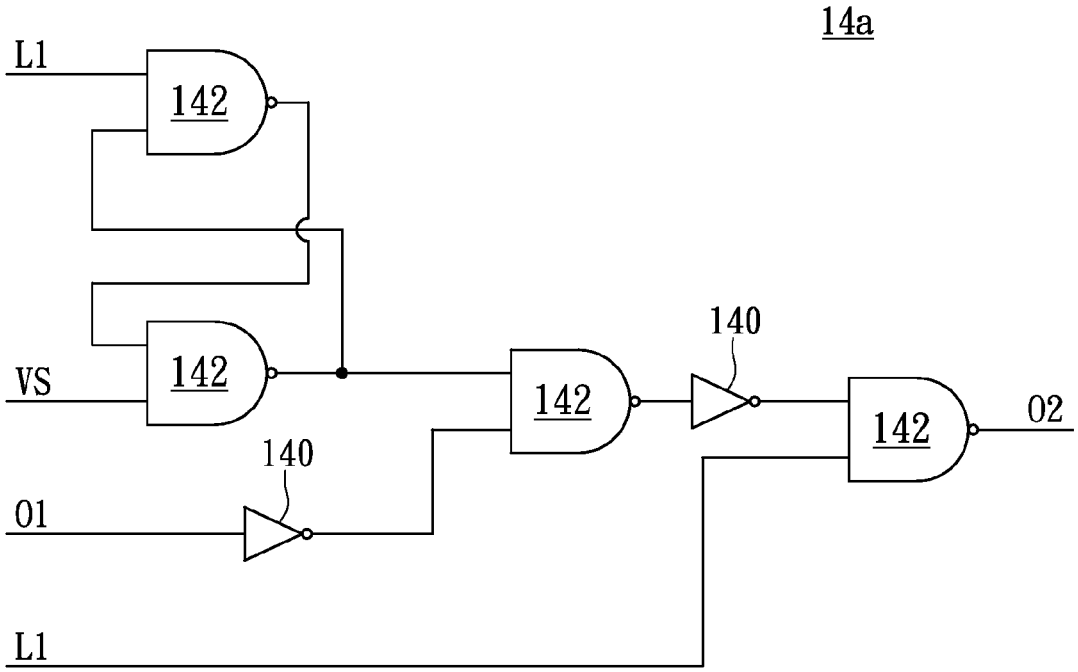
FIG. 7 shows a circuit diagram of the first logic circuit according to another embodiment of the present invention.

To clearly show the embodiment of the first logic circuit 14*a*, please refer to FIG. 7. FIG. 7 shows a circuit diagram of the first logic circuit according to another embodiment of the present invention. Herein, the first logic circuit 14*a* adjusts the high-voltage level time duration of the output status of the second time-locking signal L2 based on the sampling frequency of the first isolation signal O1 and switches the output status of the second time-locking signal L2 to a low-voltage level till the beginning of the next frame. It's noteworthy that, even though the instant embodiment depicted the circuit in FIG. 7, however those skilled in the art should be able to deduce other embodiments according to the disclosure of the present invention, and the present invention is not limited thereto.

In the instant embodiment, the first logic circuit 14*a* is properly designed to have the output status of the second time-locking signal L2 maintained at a high-voltage level at the current frame, and driving the gate driving units 220 sequentially at start of the next frame. Similar to the embodiment illustrated in FIG. 4, the instant embodiment can adjust the output status of the first time-locking signal L1 so that the output status of the second time-locking signal L2 maintains at a high-voltage level between time T1 to time T3.

Figure 8:
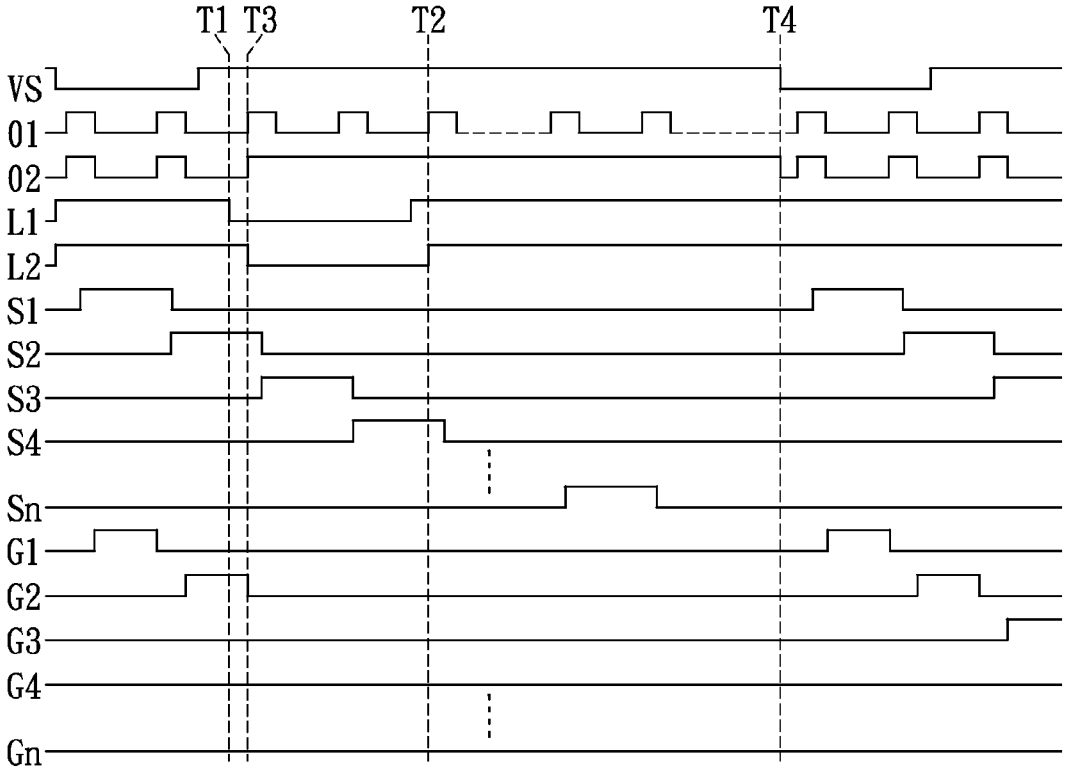
FIG. 8 shows a timing diagram according to another embodiment of the present invention.
Figure 9:
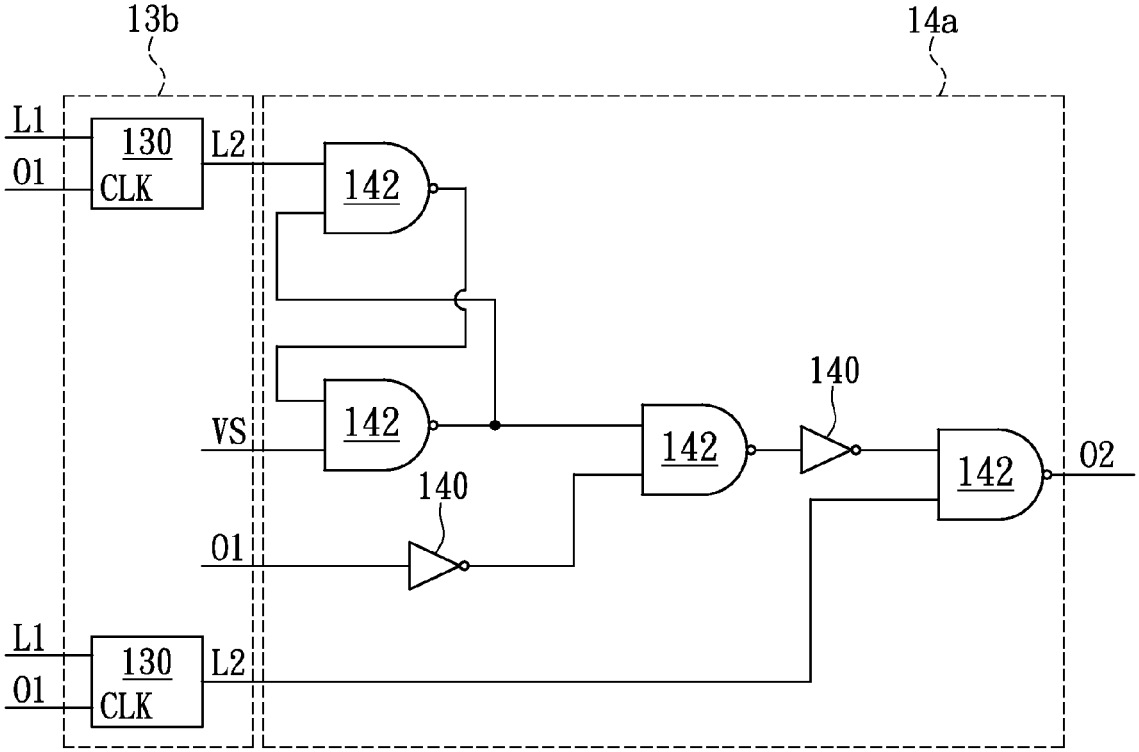
FIG. 9 shows a circuit diagram of the first logic circuit and the third logic circuit according to another embodiment of the present invention.

Please refer to FIG. 8 in conjunction with FIG. 9. FIG. 8 shows a timing diagram according to another embodiment of the present invention. FIG. 9 shows a circuit diagram of the first logic circuit and the third logic circuit according to another embodiment of the present invention. As shown in figures, the instant embodiment discloses a feasible implementation of the first logic circuit 14*a* and the second logic circuit 13*b*, wherein the second logic circuit 13*b* first configures the first time-locking signal L1 into the second time-locking signal L2, with the output status of the second time-locking signal L2 is maintained at a high-voltage level between time T1 to time T3. Subsequently, the second time-locking signal L2 outputted by the second logic circuit 13*b* replace the first time-locking signal L1 and feed in the first logic circuit 14*a*. The combination of the first logic circuit 14*a* and the second logic circuit 13*b* shown in FIG. 9 can therefore simultaneously adjust the first time-locking signal L1 and drive a plurality of gate driving units 220 in each frame.

Figure 10:
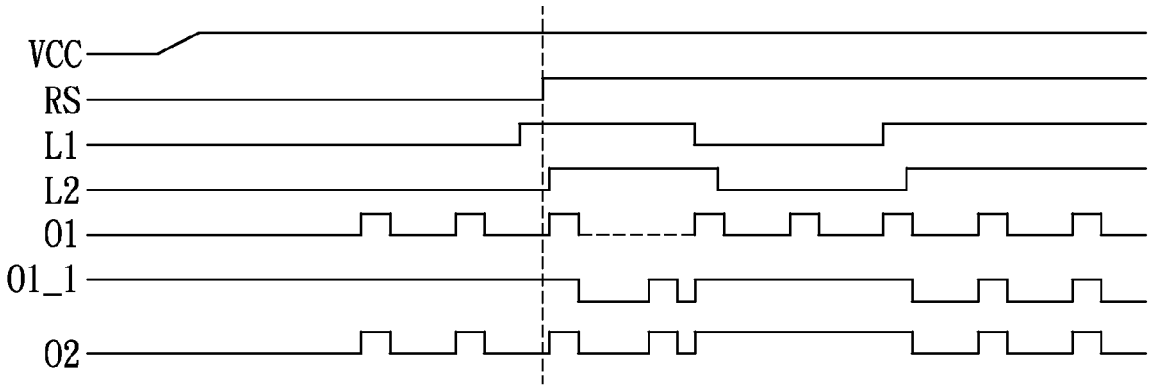
FIG. 10 shows a timing diagram illustrating the display device being powering-up.

Please refer to FIG. 1C in conjunction with FIG. 10. FIG. 10 shows a timing diagram illustrating the display device being powering-up. In instant embodiment, a power-up detection module 28 is used for detecting whether the display device 3*a* is in powering-up reset state, and outputs a power-up signal RS, accordingly. The first logic circuit 14*a* adjusts the first time-locking signal L1 and outputs the second time-locking signal L2 based on the power-up signal RS and the output statuses of both the first time-locking signal L1 and the first isolation signals O1. Specifically, when the display device 3*a* is turned on with the power-up signal RS outputted indicating that the display device 3*a* is in powering-up reset state, the power-up detection module 28 can generate the power-up signal RS through detect a power signal VCC of the display device 3*a*. For instance, within a predetermined time interval of receiving the power signal VCC (i.e. the display device 3*a* is in powering-up reset state.), the power-up detection module 28 adjusts and outputs the power-up signal RS with a low-voltage level. Accordingly, the output status of the second isolation signal O2 of the first logic circuit 14*a* can drive the gate driver 22 outputting a plurality of superimposed gate driving signals G1~Gn according to the power-up signal RS until the first logic circuit 14*a* receives the power-up signal RS and switched to a low-voltage level thereafter (i.e. the display device 3*a* exiting the powering-up reset state).

When the display device 3*a* is in the powering-up reset state, the output status of the first time-locking signal L1 (or the second time-locking signal L2) has not yet switched to a high-voltage level (i.e. the gate driving units 220 have not locked the timing signal.), the first isolation signals O1 as described in previous embodiment can be adjusted to a new first isolation signals O1_1 based on the first time-locking signal L1. However, the display device 3*a* may have predetermined images to be displayed (e.g. trade mark or specific pattern). Accordingly, the power-up detection module 28 of the instant embodiment detects first whether the display device 3*a* is in the powering-up reset state. When the display device 3*a* is in the powering-up reset state, the output status of the second isolation signal O2 outputted by the first logic circuit 14*a* is the same as the output status of the first isolation signal O1, and the predetermined images can be successfully displayed. Otherwise, the output status of the second isolation signal O2 outputted by the first logic circuit 14*a* is the same as the output status of the new first isolation signal O1_1 and the reset of operation being the same as the above embodiment, hence further descriptions are hereby omitted.

Figure 11:
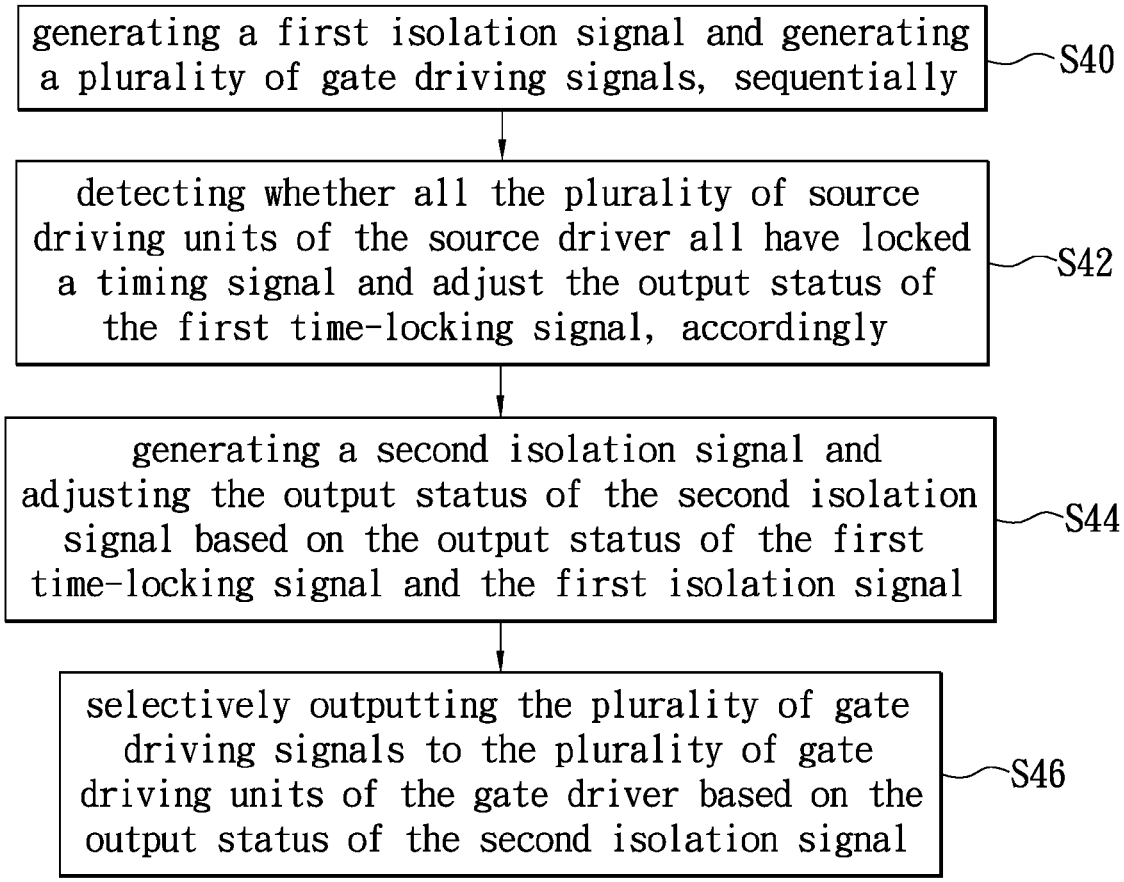
FIG. 11 shows a flow chart illustrating a driving method of a display device in accordance to another embodiment of the present invention.

A driving method of a display device is further provided in accordance to another embodiment of this invention. Please refer to FIG. 1A, FIGS. 2 and 11 at same time, wherein FIG. 11 is a flow chart illustrating a driving method of a display device in accordance to another embodiment of the present invention. In step S40, the driving signal generation module 10 generates a first isolation signal O1 and a plurality of gate driving signals S1~Sn, sequentially. In step S42, the time-locking module 12 being coupled to the source driver 20 detects whether the plurality of source driving units 200 of the source driver 20 all have locked a timing signal, and adjusts the output status of the first time-locking signal L1, accordingly. In step S44, the first logic circuit 14 generates a second isolation signal O2, and adjusts the output statuses of the second isolation signal O2 based on the output status of the first time-locking signal and the first isolation signal. At last, in step S46, the gate driver 22 selectively outputs the plurality of gate driving signals S1~Sn to the plurality of gate driving units 220 based on the output status of the second isolation signal O2.

It shall be noted, although the instant embodiment merely discloses the driving method for partial functionality of the display device, however other embodiments of the driving method have been implied in the aforementioned embodiments. Based on the above explanation, those skilled in the art should be able to infer different driving method for different timing controllers, and further descriptions are hereby omitted.

To sum up, when the display device provided by the embodiments of the instant invention happen to loose lock due to noise interference, the timing controller of the display device prevents the interfered data being written into the corresponding capacitor to have the display device continue displaying data of the previous frame. When the source driver being reconfigured by the timing controller to have correct timing signals, the time controller re-drive the gate driving units of the gate driver for new data to be written. Accordingly, the display device of the present invention assures the accuracy of display data while decreases the occurrence of displaying the black screen and abnormal image thereby improves the display quality.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. A timing controller, coupled to a source driver and a gate driver, respectively, comprising:

a driving signal generation module, generating a first isolation signal and a plurality of gate driving signals, wherein the gate driving signals are signals being outputted sequentially while the first isolation signal is a periodical pulse, the output time of each first isolation signal pulse includes the switch timing of two adjacent gate driving signals;

a time-locking module, coupled to the source driver, configured to detect whether a plurality of source driving units of the source driver all have locked a timing signal and to output a first time-locking signal;

a first logic circuit, coupled to the driving signal generation module and the time-locking module, configured to generate a second isolation signal based on the output statuses of the first time-locking signal and the first isolation signal; and a second logic circuit, respectively coupled to the driving signal generation module and the first logic circuit, adjusting the output status of the first time-locking signal based on the first isolation signal to output a second time-locking signal;

wherein the gate driver selectively outputs the gate driving signals to a plurality of gate driving units of the gate driver based on the output status of the second isolation signal;

wherein when the first logic circuit determines that the output status of the first time locking signal indicates the source driving units of the source driver all have locked the timing signal, the output status of the second isolation signal being outputted from the first logic circuit is the same as the output status of the first isolation signal; wherein when the first logic circuit determines that the output status of the first time-locking signal indicates at least one source driving unit has not locked the timing signal, the output status of the second isolation signal outputted by the first logic circuit drives the gate driver to stop outputting the gate driving signals;

wherein when the second logic circuit receives a positive-edge trigger or a negative-edge trigger of the first isolation signal, the second logic circuit records the output status of the first time-locking signal, and configures the output status of the second isolation signal output to be the output status of the first isolation signal recorded until the second logic circuit receives the next positive-edge trigger or next negative-edge trigger of the first isolation signal;

wherein the first logic circuit further adjusts the output status of the second isolation signal based on the output status of the second time-locking signal and the first isolation signal.

2. The timing controller according to claim 1, wherein the first logic circuit is further coupled to a frame synchronous module to receive a frame initialize signal being outputted from the frame synchronous module, and adjusts the output status of the second isolation signal based on the frame initialize signal and the output status of the first time-locking signal and the first isolation signal; wherein when the output status of the first time-locking signal indicates at least one source driving unit has not locked the timing signal, the output status of the second isolation signal being outputted from the first logic circuit drive the gate driver to stop outputting the gate driving signals until the output status of the first time-locking signal indicates that the source driving unit has locked the timing signal and the first logic circuit receives the frame initialize signal for the next frame.

3. The timing controller according to claim 1, wherein the first logic circuit is further coupled to a power-up detection module, detecting whether a display device is in a powering-up reset state and outputting a power-up signal, accordingly, the first logic circuit adjusting the output status of the second isolation signal based on the power-up signal, the output status of the first time-locking signal and the output status of the first isolation signal; wherein when the power-up signal indicates the display device is in the powering-up reset state, the output status of the second isolation signal configures the gate driver outputting the gate driving signals until the first logic circuit receives the power-up signal indicating the display device exited the powering-up reset state.

4. A display device, comprising:

a display panel;

a source driver, comprising a plurality of source driving units, each source driving unit at least coupled to one of a plurality of data lines in the display panel;

a gate driver, comprising a plurality of gate driving units, each gate driving unit at least coupled to one of a plurality of scan lines in the display panel; and a timing controller, respectively coupled to the source driver and the gate driver, generating a first isolation signal and a plurality of gate driving signals, sequentially, comprising:

a driving signal generation module, generating the first isolation signal and the gate driving signals, wherein the gate driving signals are signals being outputted sequentially while the first isolation signal is a periodical pulse, the output time of each first isolation signal pulse includes the switch timing of two adjacent gate driving signals;

a time-locking module, coupled to the source driver, detecting whether the source driving units all have locked a timing signal and outputting a first time-locking signal;

a first logic circuit, coupled to the driving signal generation module and the time-locking module, generating a second isolation signal based on the output status of the first time-locking signal and the first isolation signal; and a second logic circuit, respectively coupled to the driving signal generation module, the time-locking module, and the first logic circuit, adjusting the output status of the first time-locking signal to output a second time-locking signal based on the first isolation signal;

wherein the gate driver selectively outputs the gate driving signals to the plurality of gate driving units of the gate driver based on the output status of the second isolation signal;

wherein when the first logic circuit determines that the output status of the first time locking signal indicates the source driving units of the source driver all have locked the timing signal, the output status of the second isolation signal being outputted from the first logic circuit is the same as the output status of the first isolation signal; wherein when the first logic circuit determines that the output status of the first time-locking signal indicates that at least one source driving unit has not locked the timing signal, the output status of the second isolation signal outputted from the first logic circuit drives the gate driver to stop outputting the gate driving signals;

wherein when the second logic circuit receives a positive-edge trigger or a negative-edge trigger of the first isolation signal, the second logic circuit records the output status of the first time-locking signal and configures the output status of the second isolation signal output to be the same as the recorded output status of the first isolation signal until the second logic circuit receives the next positive-edge trigger or the next negative-edge trigger of the first isolation signal;

wherein the first logic circuit further adjusts the output status of the second isolation signal based on the output status of the second time-locking signal and the first isolation signal.

5. The display device according to claim 4, wherein the display device further comprises a frame synchronous module, the first logic circuit coupled to the frame synchronous module for receiving a frame initial signal outputted from the frame synchronous module and adjusting the output status of the second isolation signal based on the frame initialize signal and the output status of the first time-locking signal and the first isolation signal; wherein when the output status of the first time-locking signal indicates that at least one source driving unit has not locked the timing signal, the output status of the second isolation signal being outputted from the first logic circuit drives the gate driver to stop outputting the gate driving signals until the output status of the first time-locking signal indicates that the source driving unit has locked the timing signal and the first logic circuit receives the frame initialize signal for next frame.

6. The display device according to claim 4, wherein the display device further comprises a power-up detection module, coupled to the first logic circuit, configured to detect whether a display device is in a powering-up reset state and output a power-up signal, accordingly, the first logic circuit adjusting the output status of the second isolation signal based on the power-up signal and the output statues of the first time-locking signal and the first isolation signal; wherein when the power-up signal indicates that the display device is in the powering-up reset state, the output status of the second isolation signal drives the gate driver outputting the gate driving signals until the first logic circuit receives the power-up signal indicating that the display device exiting the powering-up reset state.

7. A driving method of a display device, comprising:

generating a first isolation signal and a plurality of gate driving signals, wherein the gate driving signals are signals being outputted sequentially while the first isolation signal is a periodical pulse, the output time of each first isolation signal pulse includes the switch timing of two adjacent gate driving signals;

detecting whether a plurality of source driving units all have locked a timing signal and outputting a first time-locking signal;

generating a second isolation signal based on the output statuses of the first time-locking signal and the first isolation signal;

a gate driver selectively outputs a plurality of gate driving signals to a plurality of gate driving units of the gate driver based on the output status of the second isolation signal; and adjusting the output status of the first time-locking signal based on the first isolation signal so as to output a second time-locking signal;

when the output status of the first time-locking signal indicates that the source driving units all have locked a timing signal, configuring the output status of the second isolation signal to be the same as the output status of the first isolation signal; when the output status of the first time-locking signal indicates that at least one source driving unit has not locked the timing signal, the output status of the second isolation signal indicates to stop outputting the gate driving signals;

wherein when the first isolation signal is positive-edge triggered or negative-edge triggered, recording the output status of the first time-locking signal and configuring the output status of the second isolation signal to be the same as the output status of the first isolation signal recorded until the first isolation signal being positive-edge triggered or negative-edge triggered again;

wherein the step of generating the second isolation signal further comprises:

adjusting the output status of the second isolation signal based on the output status of the second time-locking signal and the first isolation signal.

8. The driving method of a display device according to claim 7, wherein the step of generating the second isolation signal further comprises:

adjusting the output status of the second isolation signal based on a frame initialize signal, the output status of the first time-locking signal, and the output status of the first isolation signal, wherein when the output status of the first time-locking signal indicates at least one source driving unit has not locked the timing signal, the output status of the second isolation signal indicates to stop outputting the gate driving signals until the output status of the first time-locking signal indicates that the source driving unit has locked the timing signal and the frame initialize signal indicates the beginning of the next frame.

9. The driving method of a display device according to claim 7, wherein the step of generating the second isolation signal further comprises:

detecting whether a display device is in a powering-up reset state and outputting a power-up signal, accordingly; adjusting the output status of the second isolation signal based on the power-up signal and the output statues of the first time-locking signal and the first isolation signal; wherein when the power-up signal indicates that the display device is in the powering-up reset state, the output status of the second isolation signal indicates outputting the gate driving signals until the power-up signal indicates that the display device is exiting the powering-up reset state.

* * * * *